United States Patent [19]

Champlin

[11] 4,300,680

[45] Nov. 17, 1981

[54] ARTICLE CARRIER

[75] Inventor: Charles L. Champlin, Rittman, Ohio

[73] Assignee: Packaging Corporation of America, Evanston, Ill.

[21] Appl. No.: 149,022

[22] Filed: May 12, 1980

[51] Int. Cl.[3] ..... B65D 5/36; B65D 5/46

[52] U.S. Cl. ..... 206/427; 206/141; 229/40; 229/52 BC

[58] Field of Search ..... 206/140, 141, 155, 158, 206/427, 434; 229/40, 52 B, 52 BC

[56] References Cited

U.S. PATENT DOCUMENTS

| | | | |
|---|---|---|---|
| 3,176,902 | 4/1965 | Champlin | 206/140 |
| 3,186,545 | 6/1965 | Canrades | 206/140 |
| 3,356,283 | 12/1967 | Champlin | 229/40 |
| 4,240,546 | 12/1980 | Stone | 206/427 |
| 4,256,226 | 3/1981 | Stone | 206/427 |

*Primary Examiner*—Herbert F. Ross

*Attorney, Agent, or Firm*—Neuman, Williams, Anderson & Olson

[57] ABSTRACT

An article carrier is provided which is adapted to assume a first mode wherein the articles accommodated within the carrier are substantially concealed therein and adjacent articles are retained in a predetermined, non-contacting relation. The carrier is also adapted to subsequently assume a second mode wherein the interior of the carrier is formed into at least two contiguous open top compartments. The compartments are adapted to accommodate the articles once they have initially been removed from the carrier when the latter is in the first mode.

10 Claims, 12 Drawing Figures

FIG. 2
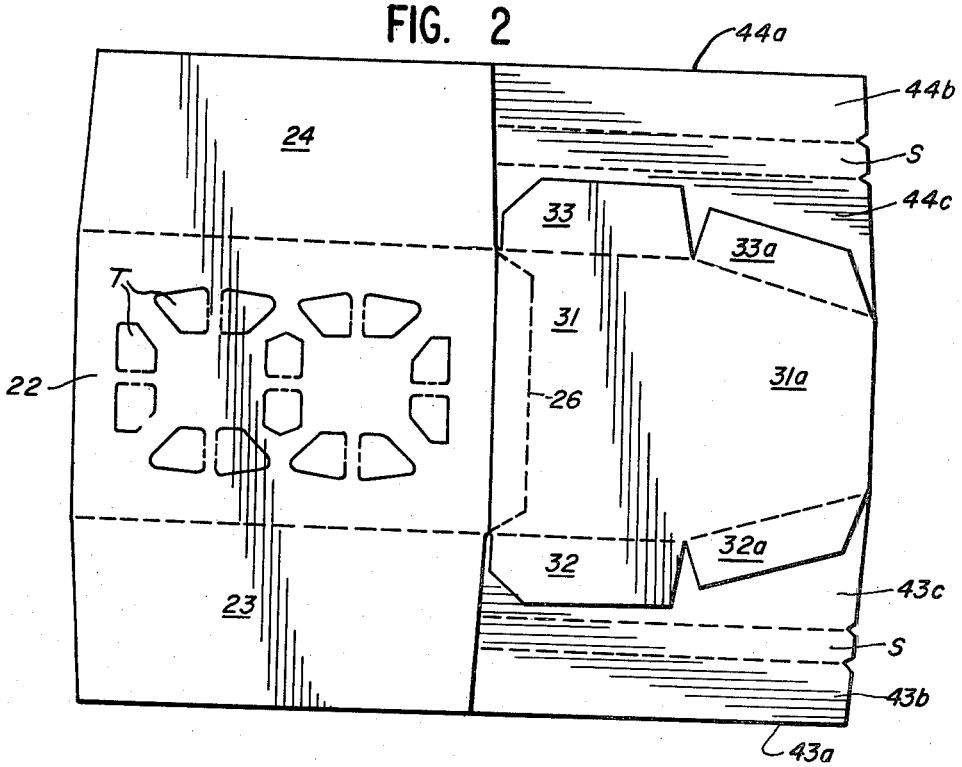
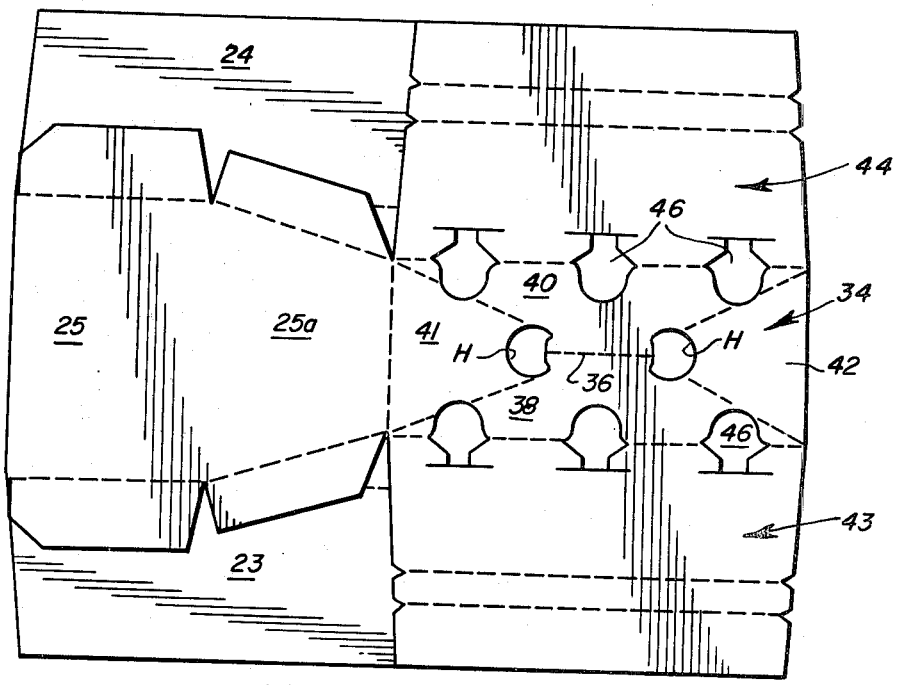
FIG. 3

FIG. 8
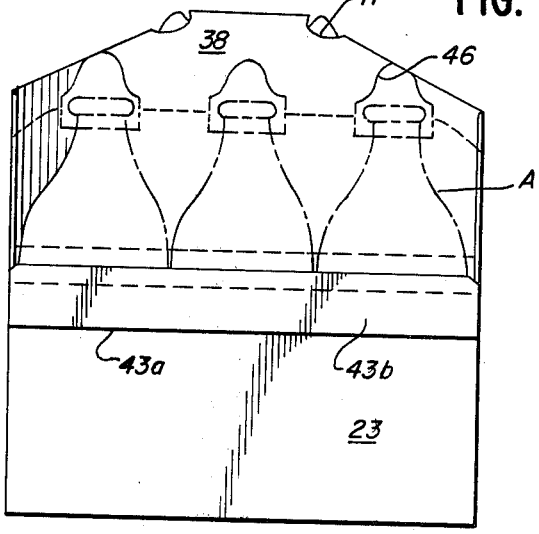
FIG. 10
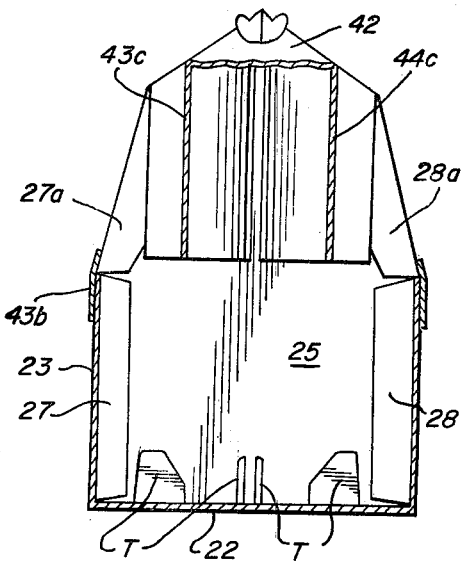
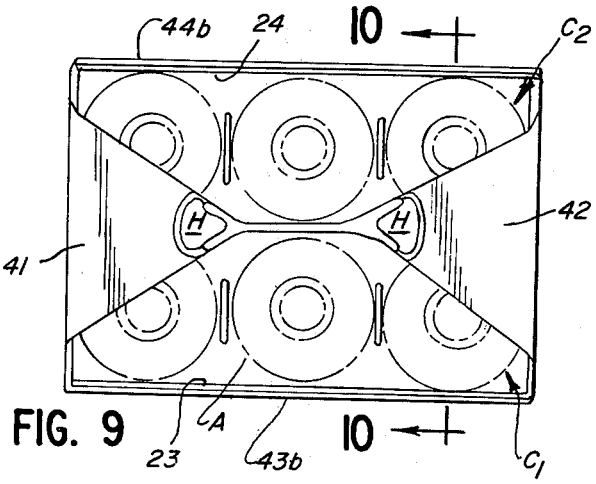
FIG. 9
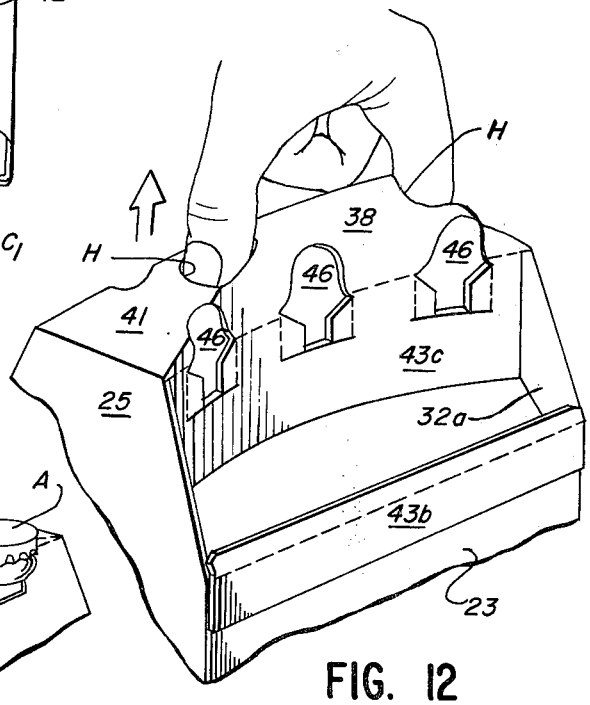
FIG. 12
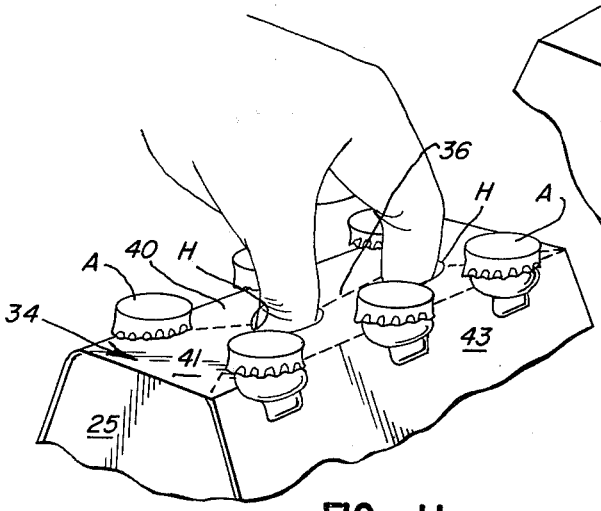
FIG. 11

ARTICLE CARRIER

BACKGROUND OF THE INVENTION

In the merchandising of bottled beverages and the like, it has become popular to package such articles in quantities of four, six or eight. In addition to such packaging, it has become customary in numerous instances for economic and/or ecological reasons for the customer to pay a bottle deposit so as to encourage return of the empty bottles to the place of purchase. To facilitate the return of the empty bottles, it is desirable to carry same in a suitable carrier which is capable of handling all of the empty bottles in a safe and convenient manner.

Heretofore the return of the empty bottles oftentimes required a separate carrier, such as a paper or plastic bag, because the original carrier was mutilated and rendered unusable when the bottles were initially removed from the carrier. Such was the case particularly where the original carrier was a wrap-around type (sometimes referred to as a six-pack style) and the accommodated bottles were concealed within the carrier. In many instances the wrap-around type original carrier is preferred over the conventional basket-type because: (a) the wrap-around type carrier is of cheaper construction and easier to form and load; (b) it is neater and can be more attractive in appearance because of more area of graphics; (c) it provides better protection for the bottles against breakage and defacement, and the contents of the bottles are better protected against harmful light rays; and (d) it deterred accidental or willful removal of one or more bottles from the original carrier.

Various bottle carriers have heretofore been provided; however, they were incapable of being readily converted from a wrap-around type original carrier to a basket-type carrier for use in returning empty bottles. The prior carriers were awkward and uncomfortable to manually handle and required an inordinate amount of blank material. In addition, at least certain of the prior structures were inherently weak and unstable for stacking.

SUMMARY OF THE INVENTION

Thus, it is an object of the invention to provide a single carrier which in a first or initial mode forms an effective wrap-around type carrier for a plurality of bottles or the like and subsequently may be readily converted into a basket-type carrier to facilitate simultaneous return of all the empty bottles.

It is a further object to provide a single carrier which in one mode embodies all of the aforenoted advantages of a wrap-around carrier and in a second mode embodies all of the advantages of a basket-type carrier.

It is a further object to provide an improved carrier which may be readily converted from a wrap-around carrier to a basket-type carrier by a simple manual manipulation without the need for special tools, adhesive and the like.

It is a still further object to provide an improved carrier which is formed from a single blank of inexpensive foldable sheet material and is capable of being initially set up and loaded by conventional highspeed equipment.

Further and additional objects will appear from the description, accompanying drawings and appended claims.

In accordance with one embodiment of the invention, an article (e.g., bottle) carrier is provided which is adapted in either of two modes to accommodate a plurality of articles arranged in a pair of coextensive substantially parallel rows. When in a first mode, the carrier substantially conceals the accommodated articles from view and from harmful light rays, and effectively retains the adjacent accommodated articles in proper relatively spaced relation when the carrier is subjected to normal handling. When the carrier is in a second mode, it is provided with a pair of contiguous open top compartments, each compartment being adapted to accommodate a row of empty articles.

The carrier includes a base panel subtending and supportingly engaging the rows of articles. Connected to opposed peripheral segments of the base panel and extending upright therefrom are a pair of end panels which are disposed adjacent opposite ends of the rows of articles. A pair of opposed upright side panels are foldably connected to second peripheral segments of the base panel. Each side panel is disposed adjacent all of the articles forming a row. Spanning the distance between the end panels and interconnecting corresponding upper peripheral segments of the end panels is an elongated hand-gripping unit. The unit includes a top panel having a plurality of folding scores formed therein and defining a pair of elongated major sections foldably connected to one another and arranged in side-by-side relation. A pair of minor sections are also defined by the folding scores and are separated from one another by the folding connection between the major sections. Foldably connected to the major sections of the top panel is a pair of article-retaining flaps. When the carrier is in the first mode, the major and minor sections of the unit top panel form a substantially common plane which is disposed in a vertically spaced, substantially parallel relation with respect to the base panel. While the major and minor sections are in coplanar relation, the article-retaining flaps extend outwardly and downwardly therefrom and each has an outer distal edge portion secured to the upper portion of an adjacent side panel.

When the carrier is in its second mode, the flaps are separated from the side panels and the major sections are folded relative to one another into a depending substantially face-to-face relation and the separated flaps depend from the major sections and each flap is substantially coplanar with the respective major section. When the major sections assume the face-to-face relation, the minor sections extend convergently upwardly from the upper peripheral segments of the end panels. When the carrier is in the second mode, the base, side and end panels and the handgripping unit coact to form contiguous elongated compartments in which the rows of articles are accommodated.

DESCRIPTION

For a more complete understanding of the invention, reference should be made to the drawings wherein:

FIG. 2 is a bottom plan view of the blank of FIG. 1 but in a folded collapsed condition.

FIG. 3 is a top plan view of the blank of FIG. 2.

FIG. 8 is a side elevational view of the improved carrier in its second mode and showing in phantom lines a row of articles accommodated therein.

FIG. 9 is a top view of the carrier of FIG. 8 and showing in phantom lines two rows of articles accommodated therein.

FIG. 10 is a fragmentary sectional view taken along line 10—10 of FIG. 9.

FIG. 11 is an enlarged fragmentary perspective view of the improved carrier in its first mode and shown being manually carried by fingers engaging the finger holes in the top panel.

FIG. 12 is similar to FIG. 11 but showing the improved carrier in its second mode and being manually carried by fingers engaging the finger holes in the top panel.

Figure 1:
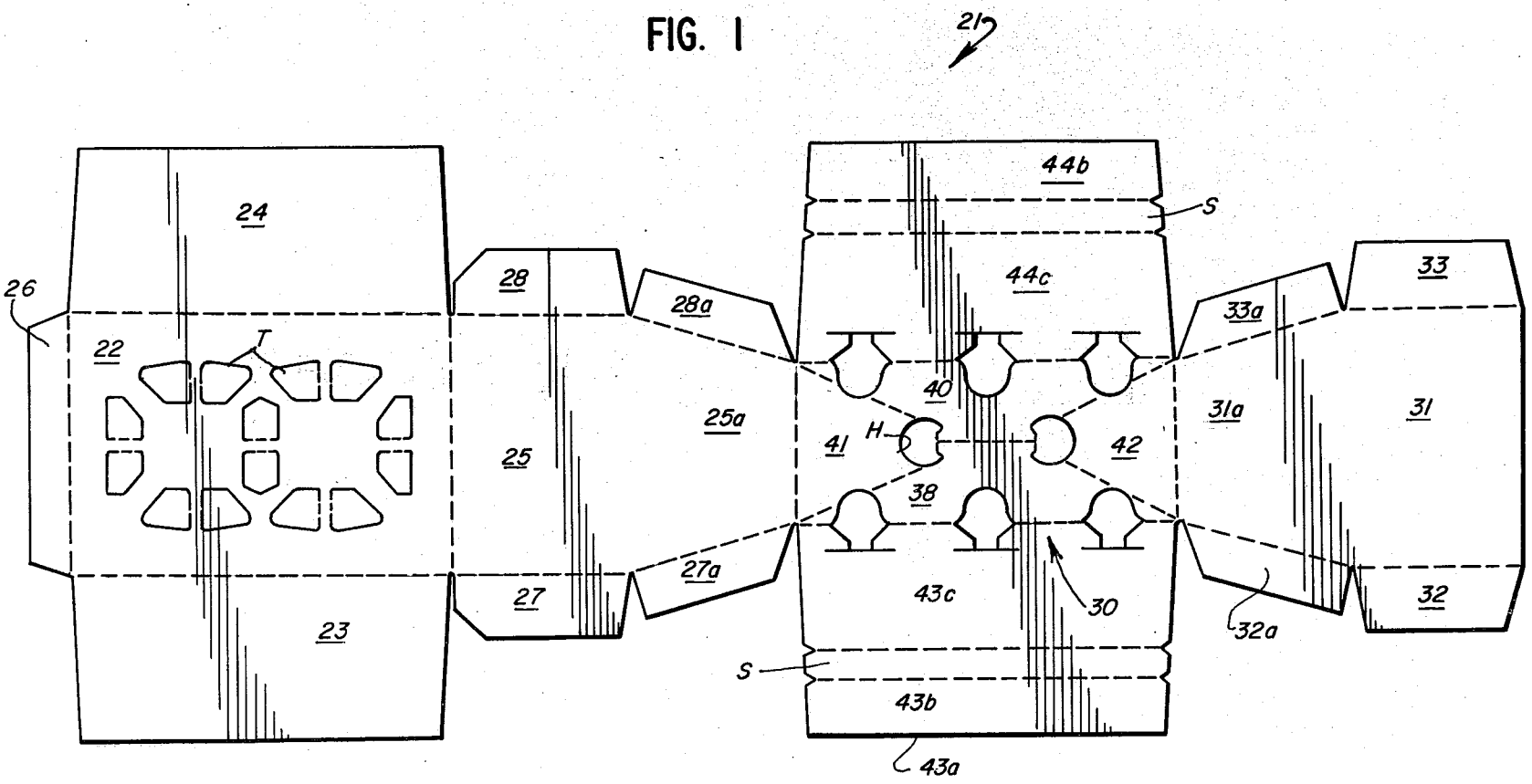
FIG. 1 is a top plan view of a blank for one embodiment of the improved carrier.

Referring now to the drawings, one embodiment of an improved carrier 20 is shown which is capable of initially functioning in a first mode I (FIG. 5) as a wrap-around style carrier, and subsequently in a second mode II (FIG. 7) as a basket-style carrier.

When in the first mode I, the carrier 20 is sized to accommodate a predetermined number (e.g., four, six, etc.) of articles A which are arranged in two parallel coextensive rows $R_1$, $R_2$. In the illustrated embodiment, each row $R_1$ $R_2$ consists of three articles (necked bottles) disposed in side-by-side relation. As previously noted, the advantages of a wrap-around style carrier are: (a) set up and loading of carrier may be readily accomplished by conventional high-speed equipment well known in the packaging art; (b) the blank is of simple and inexpensive construction; (c) the accommodated articles are protected against breakage due to striking one another when the loaded carrier is subjected to normal handling, and the contents of the articles are protected against harmful light rays; (d) the carrier has an esthetic appearance because of substantial exposed areas for graphics and the like; and (e) the loaded carriers are compact and can be arranged during storage or in bulk shipment so as to form a stable stack.

As will be discussed more fully hereinafter, the carrier 20 may be readily converted from the wrap-around style I to the basket-style II without requiring any tools or additional fastening means, such as staples, adhesive, etc.

Figure 4:
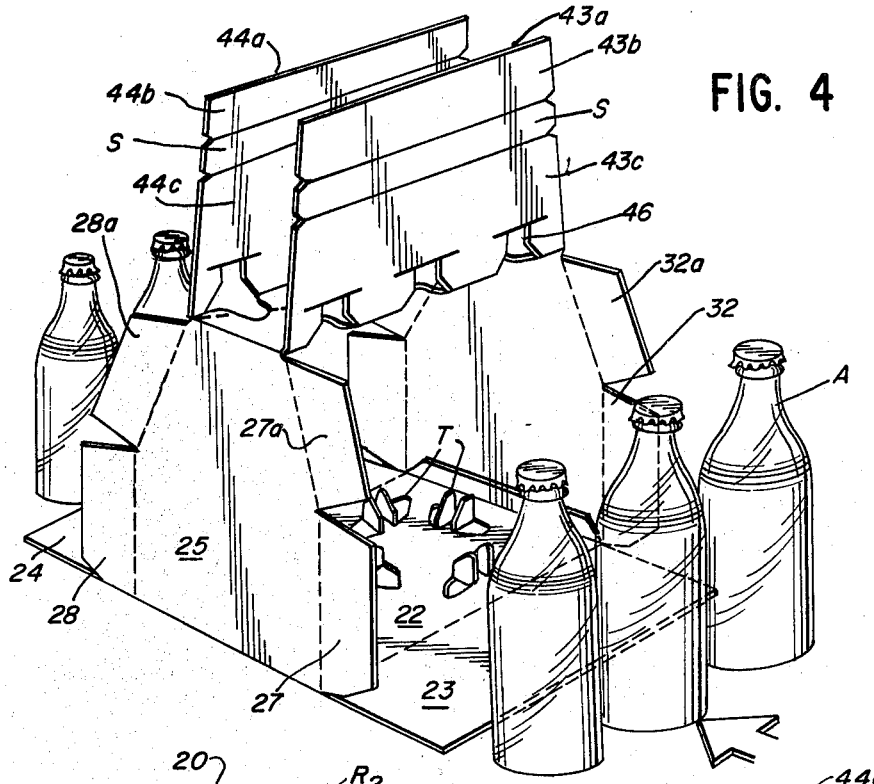
FIG. 4 is a perspective view of the blank of FIG. 3 set up for loading.

One version of the improved carrier 20 is formed from a single blank 21 of paperboard shown in FIG. 1. The paperboard is preferably of a type wherein only one surface thereof, namely, the surface which is exposed when the carrier is set up, is finished to receive graphics or other indicia. Blank 21 includes a base panel 22 which subtends and supportingly engages the rows of articles A. The panel 22 is preferably provided with strategically located pairs of push-up tabs T. The tabs are of conventional design and each pair of tabs, when in their upright positions, see FIG. 4, is adapted to be disposed between the lower portions of adjacent articles and, thus, prevent direct contact between adjacent articles when the carrier is subjected to normal handling.

Foldably connected to opposed (up and down as viewed in FIG. 1) peripheral segments of base panel 22 is a pair of side panels 23, 24. Extending laterally from one end of base panel 22 and foldably connected thereto is an end panel 25. Opposite end panel 25 and foldably connected to base panel 22 is a conventional glue flap 26. To the side edges of end panel 25 are foldably connected tuck flaps 27, 28.

The portion 25*a* of the end panel, which becomes the upper portion when the blank is set up to form carrier 20, is tapered as shown. To the tapered side edges of upper portion 25*a* are foldably connected second tuck flaps 27*a*, 28*a*.

The top edge of the end panel is quite broad in the illustrated embodiment and has foldably connected thereto an elongated hand-gripping unit 30. Opposite end panel 25 and foldably connected to unit 30 is a second end panel 31 which is of substantially the same configuration as end panel 25. Like sets of tuck flaps 32, 32*a*, and 33, 33*a* are foldably connected to edges of end panel 31.

The hand-gripping unit 30, as seen more clearly in FIG. 3, includes a top panel 34 which is provided with a plurality of folding scores 35*a*, 35*b*, 36, 37*a*, 37*b*. The folding scores coact to define a pair of major sections 38, 40 and a pair of minor sections 41, 42. The minor sections in the illustrated embodiment are of like triangular configuration, and have corresponding sides thereof foldably connected to the broad top edges of the end panels 25, 31. The minor sections are disposed in aligned opposed relation and are separated from one another by folding score 36. Located at opposite ends of folding score 36 are finger holes H which are formed in minor sections 41, 42. The folding score 36 provides a common foldline for the major sections 38, 40.

Foldably connected to the elongated edge of each major section opposite the folding score 36 is an article-retaining flap 43, 44. The foldlines 45 connecting the flaps to the elongated edges of the major sections 38, 40 are interrupted by a plurality of laterally spaced openings 46. Each opening has a first portion thereof formed in the adjacent major section of the top panel 34, and a second portion thereof formed in the flap connected to the major section. The opening portions in the illustrated embodiment are sized so that, when the carrier assumes its first mode I, see FIG. 5, they will snugly embrace the neck portion of the article beneath the cap secured to the top of the article.

Each article-retaining flap 43, 44 is provided with an elongated tear strip S which is disposed adjacent to, but spaced from, the outer distal edge 43*a*, 44*a* of the flap. The portion 43*b*, 44*b* of the flap 43, 44 located between the tear strip S and the distal edge overlies and is secured by adhesive or the like to the upper edge portion of an adjacent side panel 23, 24 when the blank is set up to form the carrier 20 in its first mode I, as will be described more fully hereinafter.

FIGS. 2 and 3 show blank 21 in its initial folded or collapsed state, wherein the base panel 22 and the side panels 23, 24 and glue flap 26 connected thereto are folded as a unit about the folding connection between panel 22 and end panel 25 so as to subtend the remainder of the blank. End panel 31 and its associated tuck flaps are then folded as a unit about the folding connection between the end panel 31 and minor section 42 so as to subtend the remainder of the blank. Because of the relative dimensions of the hand-gripping unit 30 and the various panels of the blank, the free (bottom) edge of end panel 31 will overlie and be adhesively secured to glue flap 26, see FIG. 2. While the blank is in the collapsed state, FIGS. 2, 3, it may be readily stored or shipped in bulk to the bottler.

When the carrier is to be loaded, the collapsed blank is squared up so that the base panel 22 is horizontal and the end panels 25, 31 are in parallel upright relation, see FIG. 4. In addition the flaps 43, 44 are folded relative to the top panel 34 so as to assume upright positions. The tuck flaps and side panels remain in unfolded condition, thus providing open sides through which rows of articles are moved simultaneously in opposite direction until the articles of the rows are properly spotted on the base panel 22. Before the articles are moved onto the base panel 22, the push-up tabs T are manipulated to their upright positions, see FIG. 4. The spacing between the pair of tabs is such that substantial tangential engagement will occur between the exterior of the lower portion of the article and an upright tab, when the article is properly located on the base panel. The openings 46 formed in the top panel 34 and proximate portions of the flaps 43, 44 will retain the upper neck portions of the article in proper spaced relation.

When the rows of articles are moved through the open sides of the squared up carrier, FIG. 4, the capped upper ends of the articles will slide through the portions of the opening 46 formed in the up-turned flaps 43, 44 and come to rest within the other portions of the openings formed in the major sections 38, 40 of the top panel 34. During this loading operation, the major and minor sections of the top panel remain in a substantially coplanar relation thereby facilitating the loading operation.

Once the rows of articles have been spotted on the base panel 22, the tuck flaps 27, 27*a*; 28, 28*a*; 32,32*a*; 33, 33*a* are folded inwardly so as to partially overlie the exterior of an adjacent end article of a row. The side panels 23, 24 are then folded upwardly and are adhesively secured to tuck flaps 27, 28, 32, 33. Once the side panels 23, 24 are held fast in their upright positions by the adjacent tuck flaps, the article-retaining flaps 43, 44 are then folded outwardly and downwardly relative to the top panel, and the distal portions 43*b*, 44*b* of the flaps are adhesively secured to the exterior of the upper edge portions of the side panels. It will be noted in FIG. 5 that the tear strip S in each flap 43, 44 is not adhesively secured to the adjacent side panel. The location of the tear strip S relative to the side panel and top panel may vary from that shown, if desired.

Once the flaps 43, 44 have been adhesively secured to the adjacent side panel 23, 24, the carrier is in a first mode and assumes a wrap-around style carrier, wherein the accommodated articles are snugly concealed therein.

When the carrier in the first mode is to be picked up and manually carried, the thumb and the forefinger or index finger of one hand is inserted through the finger holes H formed in the top panel 34 and the portion of the top panel between the holes H is grasped thereby, as seen in FIG. 11. When lifting occurs, the portion of the top panel located between the holes will be raised and bow upwardly a slight amount about the folding score 36 as an axis, thereby effecting a substantially rib-like strut which forms a strong tear-resistant handle for carrying the loaded carrier.

Figure 5:
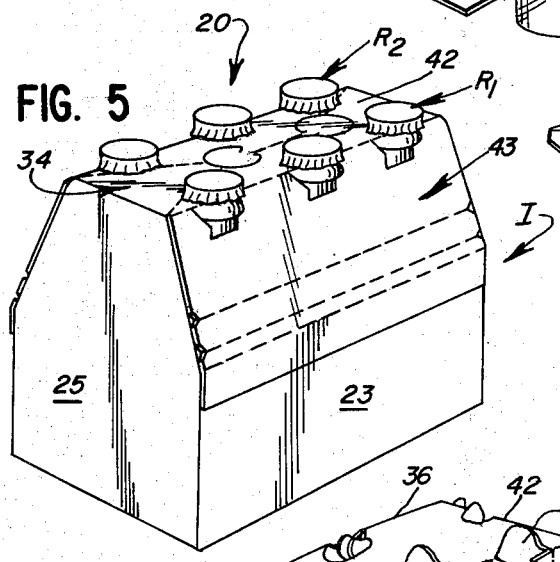
FIG. 5 is a perspective view of the improved carrier formed from the blank of FIG. 1 and shown fully loaded and in its first (wrap-around style) mode.
Figure 6:
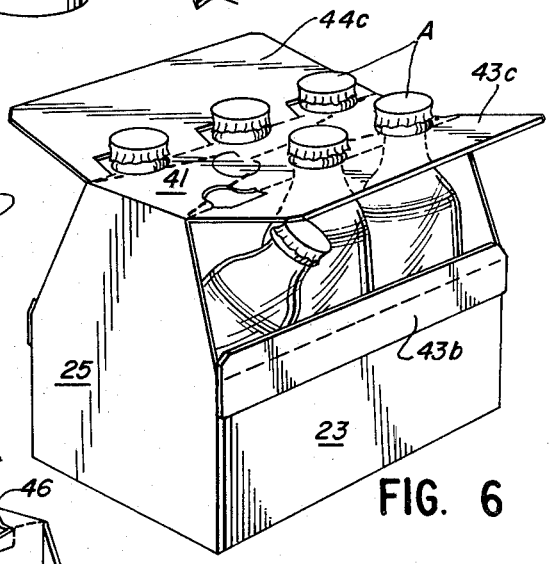
FIG. 6 is similar to FIG. 5 but showing the improved carrier initially opened to remove the individual articles therefrom.

When the articles are to be removed from the carrier of FIG. 5, the tear strips S are manually torn away, thereby leaving the distal portions 43*b*, 44*b* of the flaps attached to the exterior of the side panels. The remainder 43*c*, 44*c* of the flaps 43, 44 are then free to be manually folded upwardly, thereby enabling the neck portions of the articles to be readily disengaged from the openings 46 without mutilating the carrier, see FIG. 6.

When all of the articles have been initially removed from the carrier, the remaining portions 43*c*, 44*c* of the flaps 43, 44 and the major sections 38, 40 to which they are connected are folded downwardly together about folding score 36 as an axis into the interior of the carrier so as to form a substantially vertical partition P. Simultaneously with the downward folding of the major sections and the remaining portions of the flaps, the minor sections 41, 42 will automatically move out of a coplanar relation and extend convergently upwardly from the upper edges of the end panels as is seen more clearly in FIG. 8. This upward movement of the minor sections is due to the folding scores 35*a*, 35*b* and 37*a*, 37*b* which interconnect the minor sections to the end portions of the major sections.

Figure 7:
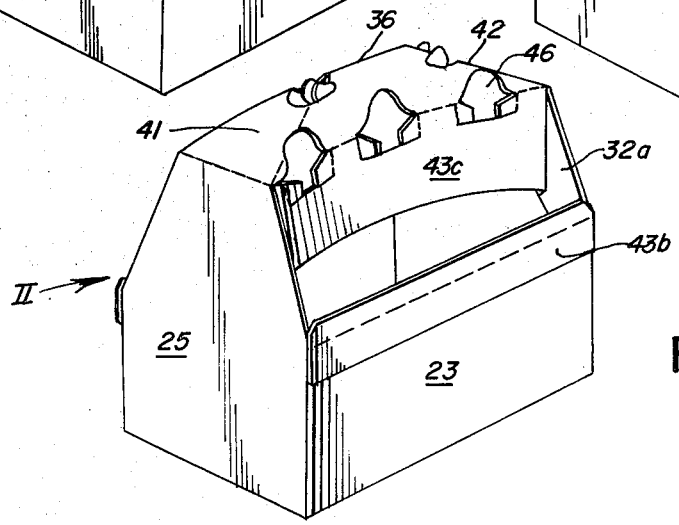
FIG. 7 is a perspective view of the improved carrier converted to its second (basket-style) mode.

As seen in FIGS. 7 and 9, the partition P forms the interior of the carrier into two, contiguous, open top compartments $C_1$, and $C_2$, each of which is adapted to accommodate a row of articles after they have been emptied of their contents. When the vertical partition has been formed, the carrier is in its second mode, which is a basket-style carrier, see FIG. 7. The partition P spans the distance between the upright end panels 25, 31 and provides a strong, substantially rigid handle which may be grasped by the thumb and finger engaging the holes H formed in the minor sections, see FIG. 12. In certain instances, if desired, the fingers may extend through one or more of the aligned openings 46 formed in the depending major sections and the portions 43*c* and 44*c* connected thereto.

To load the basket-style carrier with the empty articles merely requires the latter to be manually inserted through the open top of the compartment. Because the push-up tabs T have already assumed their upright positions, the bottoms of the empty articles may be readily spotted on the base panel 22.

Thus, it will be seen that an article carrier of simple, inexpensive construction has been provided which in one mode assumes a wrap-around style carrier, and in a second mode assumes a basket-style carrier. Conversion from the wrap-around style to the basket-style can be readily accomplished without requiring tools or additional fastening means. In either mode, the carrier may be readily grasped and manually carried. The size and shape of the improved carrier and the blank therefor may be varied from that shown without departing from the scope of the invention, and will depend in a large measure on the number, size, and shape of the articles to be accommodated thereby.

I claim:

1. An article carrier convertible from a first mode for initially accommodating a plurality of articles arranged in a pair of substantially parallel rows, to a second mode for accommodating rows of articles subsequent to the articles being initially removed from the carrier when in the first mode; said carrier comprising a base panel for subtending and supportingly engaging the rows of articles; a pair of opposed upright end panels connected to first peripheral segments of said base panel for disposition adjacent corresponding end articles of the rows; a pair of opposed upright side panels connected to second peripheral segments of said base panel for disposition adjacent all of the articles of a row, said panels being in the same predetermined angular relation when said carrier is in either mode; and a hand-gripping unit spanning the distance between said upright end panels and interconnecting corresponding upper peripheral segments of said end panels, said unit including a top panel having a plurality of folding scores formed therein and defining a pair of elongated major sections connected to one another by a common folding score and arranged in side-by-side relation, and a pair of minor sections separated from one another by said major sections, each minor section having a first peripheral segment foldably connected to the upper peripheral segment of an adjacent end panel, and second peripheral segments foldably connected to corresponding peripheral portions of said major sections, and a pair of opposed article-retaining flaps foldably connected to corresponding second peripheral portions of said major sections; when said carrier is in said first mode, said major and minor sections being disposed in substantially coplanar relation and said flaps extending outwardly and downwardly from said major sections and substantially overlying and concealing the article rows and having outer edge portions of said flaps secured to upper edge portions of the upright side panels; when said carrier is in said second mode, said major sections being folded relative to one another into substantially face-to-face relation and at least portions of said article-retaining flaps being separated from said side panels and disposed in substantially depending relation with the respective major sections and forming a pair of contiguous open top compartments, one for each article row when said carrier is in said second mode.

2. The carrier of claim 1 wherein each article-retaining flap substantially spans the distance between said end panels; and an elongated tear means is provided and substantially spans the distance between said end panels and effects separation of the flap from the adjacent side panel when said carrier is in said second mode.

3. The carrier of claim 2 wherein the tear means is provided for each article-retaining flap and is proximate the outer edge portion of said flap, said tear means being disposed in substantially parallel spaced relation with the folding connection between said flap and the major section of said unit.

4. The carrier of claim 3 wherein the folding connection between a flap and a major section is interrupted by a plurality of openings, the number of openings corresponding to the number of articles in a row, each opening being adapted to lockingly engage a portion of a corresponding article when said carrier is in said first mode; said openings being out of engagement with the articles when said carrier is in said second mode.

5. The carrier of claim 1 wherein the minor sections of the hand-gripping unit are of substantially triangular configuration, and an apex portion of each triangular minor section being in substantially aligned opposed relation.

6. The carrier of claim 5 wherein the aligned apex portions of said unit minor sections are interconnected by the common folding score connecting the peripheral portions of said major sections.

7. The carrier of claim 6 wherein the top panel of the hand-gripping unit is provided with a pair of finger holes formed substantially in the apex portions of said minor sections and being disposed at opposite ends of said common folding score.

8. The carrier of claim 7 wherein the finger holes and the common folding score are elevated relative to the upper peripheral segments of the end panels, when said carrier is in said second mode.

9. The carrier of claim 2 wherein each tear means is disposed between the adjacent side panel and the adjacent major section of said hand-gripping unit, when said carrier is in said first mode.

10. The carrier of claim 1 wherein the top panel of the hand-gripping unit, when said carrier is in the first mode, defines a plane which is in vertically spaced, substantially parallel relation with respect to the base panel and when the carrier is in the second mode, the minor sections of the unit extend convergently upwardly from the upper peripheral segments of the end panels and the common folding score is elevated relative to the end panel upper peripheral segments.

* * * * *